US005125346A

United States Patent [19]

Piepers

[11] Patent Number: 5,125,346

[45] Date of Patent: Jun. 30, 1992

[54] LIFT INSTALLATION

[76] Inventor: Harry C. Piepers, Jan Luikenstraat 44, Eindhoven, Netherlands

[21] Appl. No.: 568,957

[22] Filed: Aug. 17, 1990

[30] Foreign Application Priority Data

Aug. 18, 1989 [NL] Netherlands ..... 8902091
Mar. 16, 1990 [NL] Netherlands ..... 9000600

[51] Int. Cl.[5] ..... B61B 3/00

[52] U.S. Cl. ..... 104/127; 187/25; 187/95

[58] Field of Search ..... 104/127, 128, 129, 138.1; 187/25, 95

[56] References Cited

U.S. PATENT DOCUMENTS 62,788 3/1867 Emon ..... 187/25
374,442 12/1887 Backman ..... 187/25
698,738 4/1902 Roney ..... 187/95
765,348 7/1904 Vogel ..... 187/25
4,794,866 1/1989 Brandis et al. ..... 104/292

FOREIGN PATENT DOCUMENTS 0523015 8/1976 U.S.S.R. ..... 187/25
0012746 of 1886 United Kingdom ..... 187/25
0658022 10/1951 United Kingdom ..... 187/25

*Primary Examiner*—Douglas C. Butler
*Assistant Examiner*—Mark T. Le
*Attorney, Agent, or Firm*—Seed and Berry

[57] ABSTRACT

A lift installation provided with a vertically moveable lift cage having an entrance. The lift cage is rotatably connected to a supporting structure adapted to rotatably couple to a helical guide formed into or connected to the shaft wall. The shaft structure rotates relative to the shaft wall causing the support structure, and thus the lift cage, to move vertically. The lift cage is rotatable about the vertical axis such that the entrance can be rotated with respect to the shaft wall.

19 Claims, 6 Drawing Sheets

LIFT INSTALLATION

FIELD OF THE INVENTION

The invention relates to a lift installation provided with an up and down movable lift cage having at least one entrance, said lift cage being rotatably connected about a vertical axis of rotation to a support means, as well as with a helical rail and with wheel-shaped means cooperating with said helical rail.

DESCRIPTION OF THE PRIOR ART

Such lift installations are known from GB-A-658,022 and from FR-A-2,313,310. These known lift installations are provided with guide means in order to make the lift cage move vertically up and down, without rotating about its vertically extending central axis thereby. With such a construction it is therefore necessary that entrances to the lift cage present on different floors are all vertically disposed one above the other.

SUMMARY OF THE INVENTION

With the construction according to the invention, whereby either the helical rail forms part of a stationary construction and the wheel-shaped means are connected to the support means, or the helical rail is secured to the support means and the wheel-shaped means are supported by a stationary construction, means are provided by which the lift cage can be rotated about its axis of rotation with respect to the support means in order to turn the entrance of the lift cage through an angle with respect to the stationary construction.

By using the construction according to the invention passages located on different floors, via which the lift cage present on the floor in question will be accessible, can be disposed turned relative to each other with respect to the longitudinal axis of the lift cage, which makes such a lift installation in a surprising way much more versatile than the prior lift installations.

It is also possible that several passages which are turned relative to each other are provided on one and the same floor, via which passages the lift cage present on the floor in question will be accessible.

With the above-described known constructions the wheel-shaped means are secured to the support means supporting the lift cage, whilst the helical rail(s) form(s) part of a stationary construction. This requires a relatively great length of such (a) rail(s), and the precise manufacture of such (a) helical rail(s) will be a time-consuming and costly activity.

According to a further aspect of the invention the helical rail is coupled to the support means and the wheel-shaped means are connected to a stationary construction, helically disposed about the path of movement of the lift cage, whilst for each thread of the helical rail at least one wheel-shaped means is connected to a drive means.

When using such a construction only a comparatively short helical rail is required, so that the manufacture of such a helical rail is considerably simpler and cheaper than with the known constructions. Arranging the wheel-shaped means can also be done simply and quickly thereby.

BRIEF DESCRIPTION OF THE DRAWINGS

The invention will be explained in more detail hereinafter with reference to a few possible embodiments of the construction according to the invention illustrated in the accompanying figures.

DESCRIPTION OF THE PREFERRED EMBODIMENT

Figure 1:
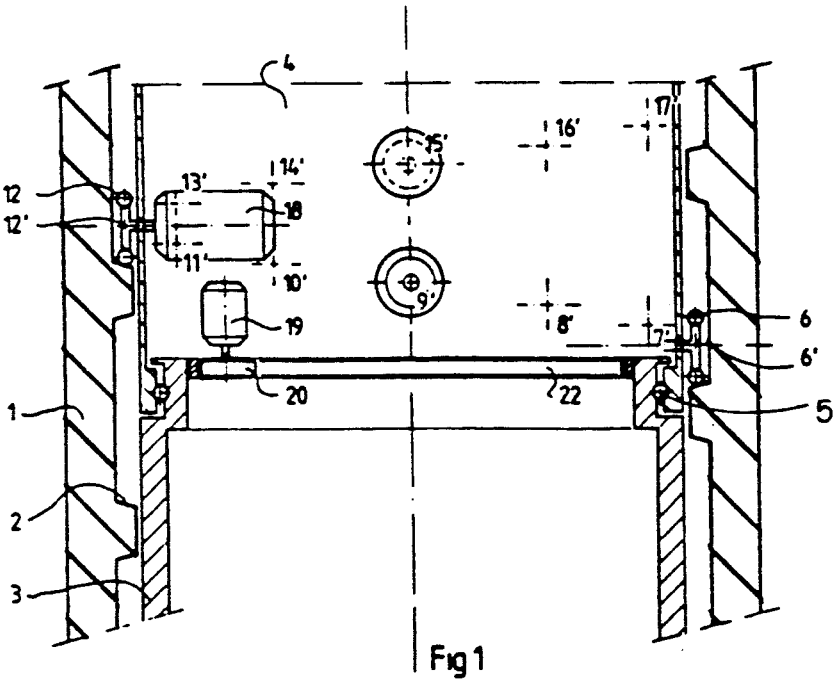
FIG. 1 is a diagrammatic cross-section of a part of a lift shaft with a part of a lift cage provided therein.
Figure 2:
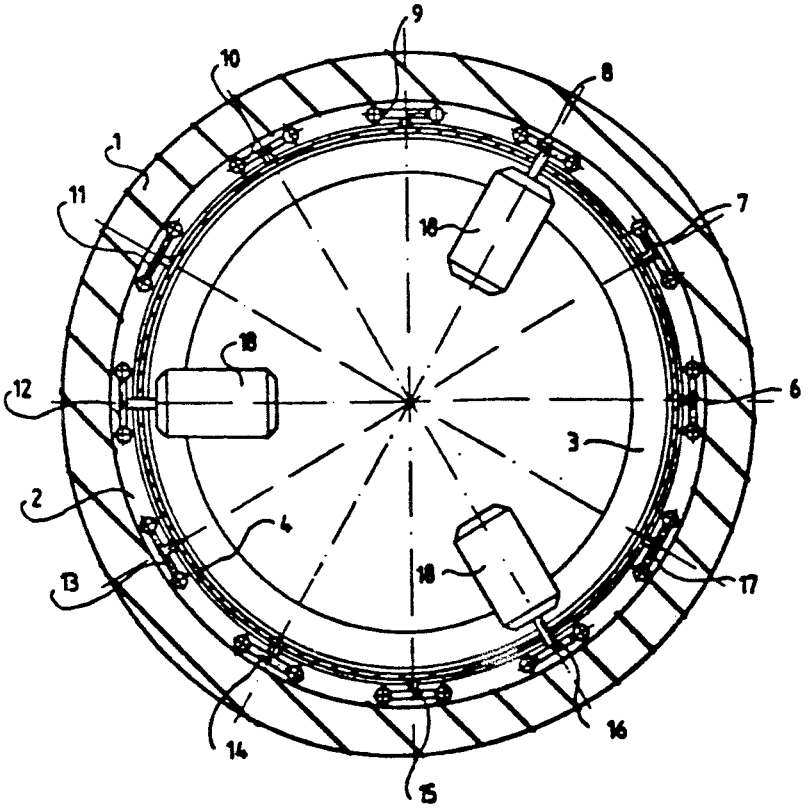
FIG. 2 is a plan view of FIG. 1.
Figure 3:
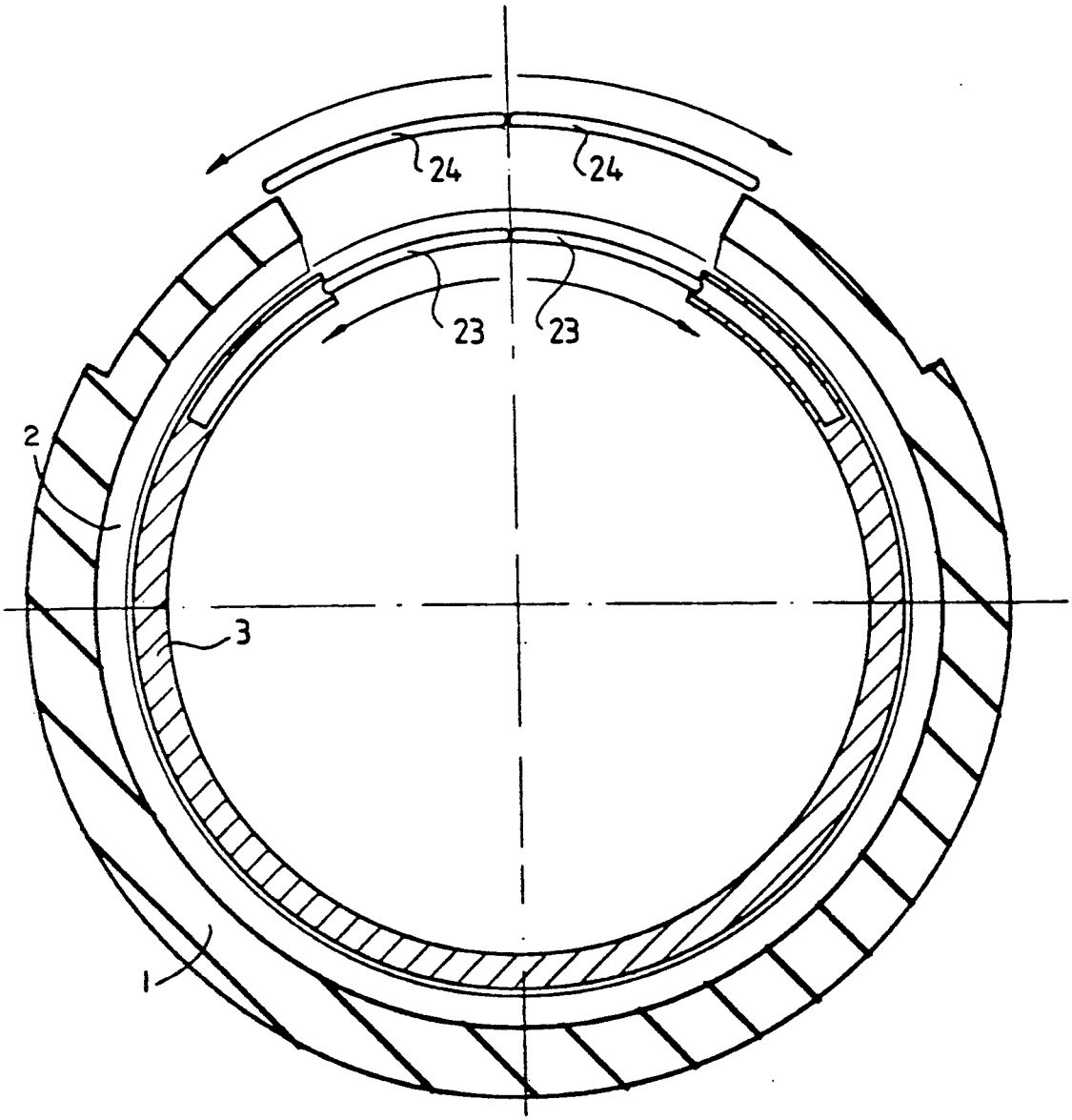
FIG. 3 is a diagrammatic section of the lift cage and the lift shaft near the doors provided in the lift cage and in the lift shaft.

As is diagrammatically illustrated in the FIGS. 1-3 the lift shaft is formed by a cylindrical shaft 1 forming a stationary construction, which may e.g. be made of concrete or the like. On the inner wall of said cylindrical shaft there is provided a rail 2 extending helically about the central axis of the shaft, said rail being integral with the lift shaft 1 in the illustrated embodiment.

A lift cage 3 is provided in the lift shaft. In the illustrated embodiment the lift cage 3 is suspended, by means of a row of balls 5, from a cylindrical shell 4 forming a support means disposed above the lift cage. On said cylindrical shell 4 there are provided twelve wheels 6–17 in the illustrated embodiment, said wheels being rotatable about horizontally extending axes of rotation 6'–17' with respect to the shell 14. As is apparent from the Figures the wheels 6–17 are thereby disposed such that all said wheels are supported on the rail 2, which extends helically about the lift cage, for supporting the lift cage on said rail.

As is furthermore illustrated in FIGS. 1 and 2 a drive motor 18, preferably an electromotor, is connected to at least a number of said wheels. It will be apparent that by setting the motors rotating in the one or the other direction the relevant wheels coupled to said motors will correspondingly be driven in the one or the other direction, and thus will roll on the rail 2 in order to vertically move the shell 4 with the cage 3 coupled thereto.

In order to prevent that the lift cage 3 will start rotating along with the shell 4 about the coinciding axes of the lift shaft 1, the lift cage 3 and the shell 4, projecting parts may be provided on the inner wall of the lift shaft 1, said projections engaging corresponding longitudinally extending grooves in the lift cage 3. In the illustrated embodiment, on the other hand, a further motor 19 is secured to the shell 4, by means of which a gear 20, rotatable about a vertical axis of rotation, can be driven in the one or the other direction. Said gear 20 is in engagement with the gears of a crown gear 22, which is provided at the upper end of the lift cage 3. It is possible, e.g. by means of suitable sensors, to check the position of the lift cage 3 and to supply signals by means of said sensors to a suitable switch gear which, if necessary, sets the motor rotating in the one or the other direction in order to keep the lift cage 3 in its intended position.

As is illustrated in FIG. 3 the lift cage 3 may be equipped with door 23 near an entrance to said lift cage, which doors can be put from a closed position into an open position by rotating bout the central axis of the lift cage 3. Two doors 24 may be similarly provided near a doorway in the lift shaft, which doors can be slightly moved outwards from their closed position illustrated in FIG. 3, and which can then be rotated in order to release the doorway in the lift shaft. Near said doorway a suitable threshold may be provided for bridging the distance between the inner wall of the lift shaft and the outer wall of the lift cage. A suitable placement of the helical rail with respect to the doorways will eliminate any risk of the wheels coming into contact with such a threshold.

The rail 2 will be locally interrupted near a doorway. Since the lift cage is suspended from a large number of wheels this will not necessarily be a drawback, however.

By using a motor 19 for keeping the lift cage 3 in its correct position it will also be possible to provide the lift shaft with doorways, which are disposed turned relative to each other about the central axis of the lift shaft. By suitably programming the circuitry controlling the motor 19 it can then be effected that the lift shaft is always rotated such that its opening which can be closed by means of the doors 23 will always be positioned in a desirable manner opposite an opening provided in the lift shaft 1.

Figure 4:
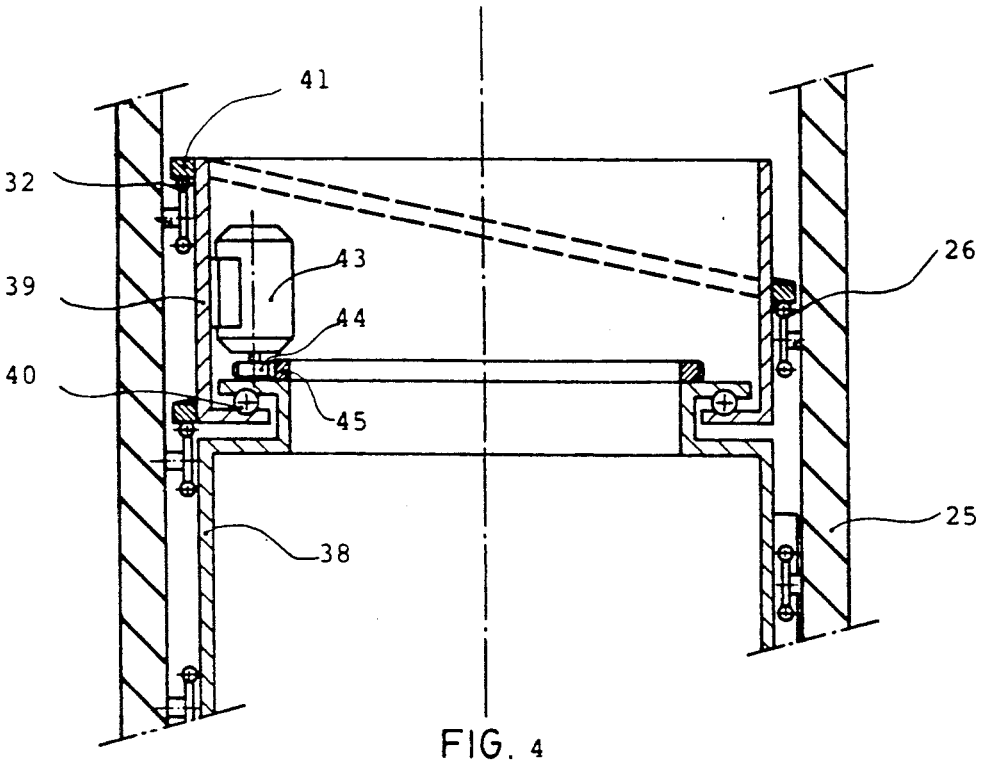
FIG. 4 is a section, corresponding with FIG. 1, of a second embodiment of the construction according to the invention.
Figure 5:
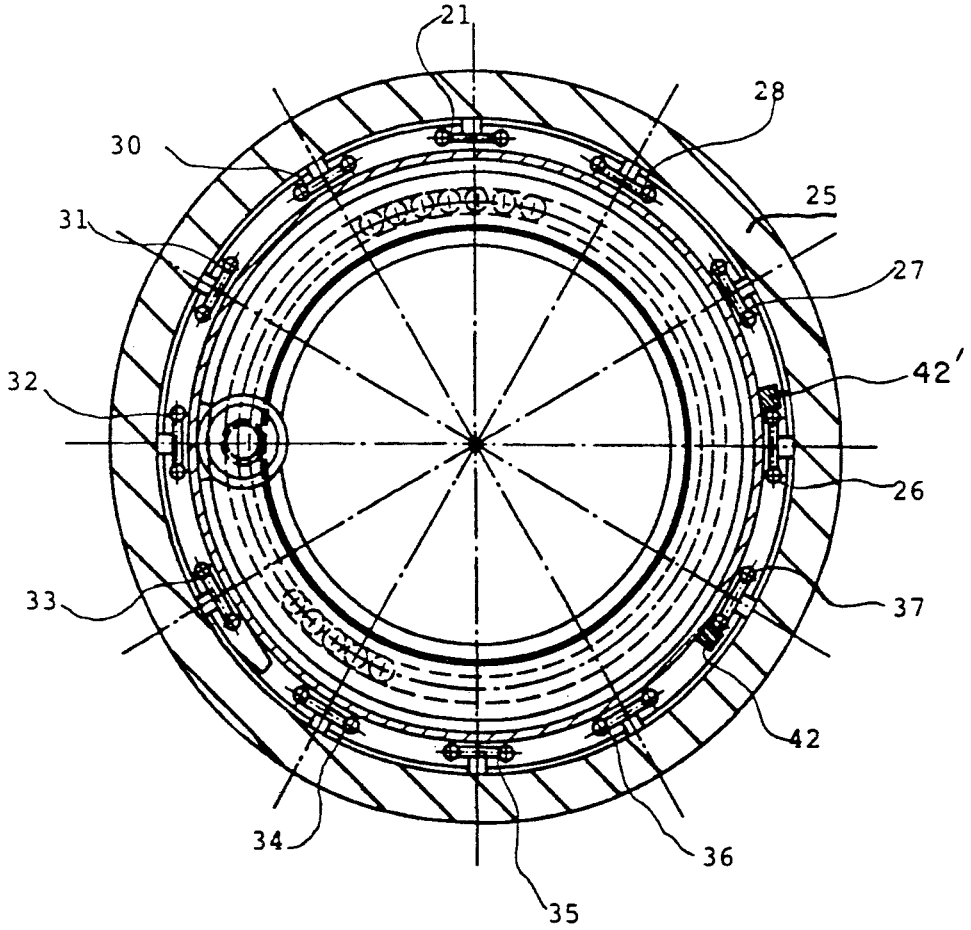
FIG. 5 is a plan view of FIG. 4.
Figure 6:
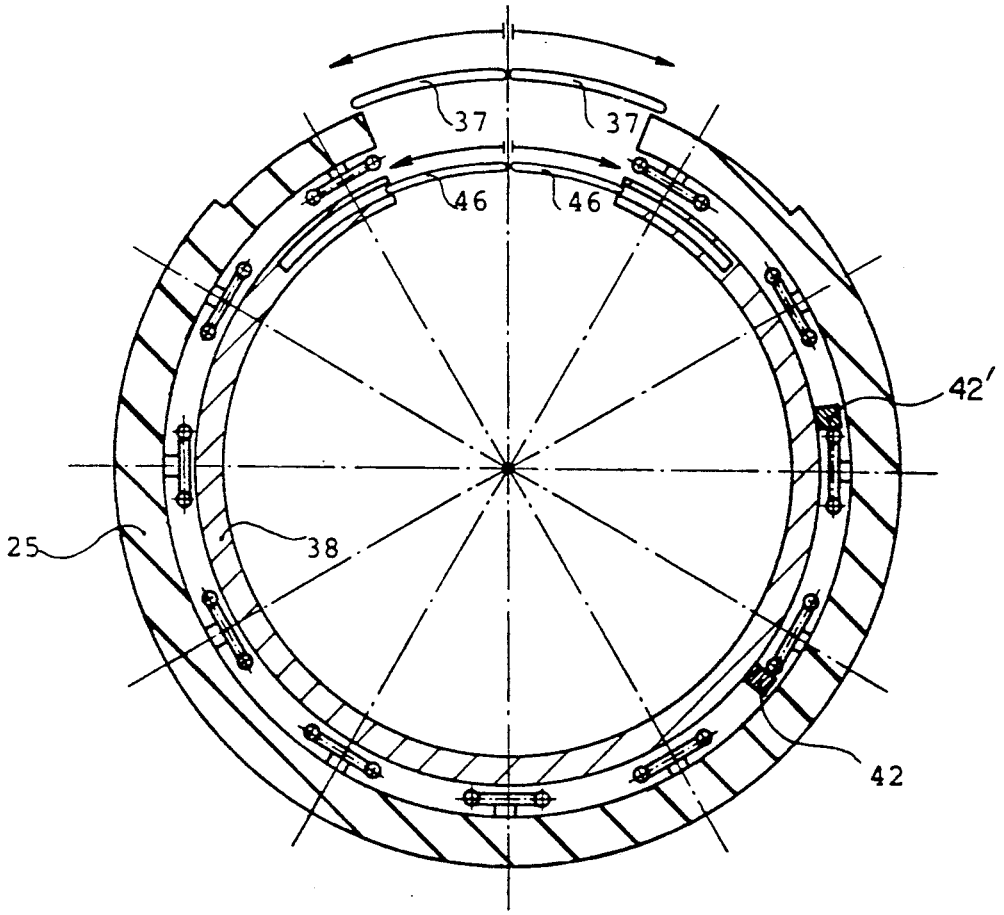
FIG. 6 is a section, corresponding with FIG. 3, of the second embodiment of a construction according to the invention.

As is diagrammatically illustrated for a second embodiment in FIGS. 4–6 the lift shaft is again formed by a cylindrical shaft 25, which may e.g. be made of concrete or the like. On the inner side of said cylindrical shaft a plurality of wheel-shaped means are helically disposed about the central axis of said shaft in the illustrated embodiment, twelve of said wheel-shaped means 26–37 being shown in FIG. 5.

The wheel-shaped means are rotatable about horizontally extending axes of rotation with respect to the lift shaft, said axes of rotation extending radially with respect to the central axis of the lift shaft. A lift cage 38 is provided in the lift shaft 25. In the illustrated embodiment the lift cage is suspended from a cylindrical shell or support means 39 disposed above the lift cage by means of a row of balls 40.

To the outer side of the cylindrical shell there is secured a helical rail 41, which is supported on at least a number of the wheel-shaped means. As is furthermore illustrated in the Figure the rotation of the lift cage about its axis may be blocked by guides 42 and 43'. On the cylindrical shell 39 there is furthermore mounted a(n) (electro)motor 43. A gear 44 which is rotatable about the central axis of the lift shaft 25 can be driven in the one or the other direction by means of said motor. Said gear 44 is in engagement with the teeth of a crown gear 45, which is provided at the upper end of the lift cage 38.

It will be apparent that setting the motor rotating in the one or the other direction will result in rotation of the shell 39 with respect to the lift cage, and thus in a vertical movement of the unit of the lift cage and the cylindrical shell.

In another embodiment an intermediate means is disposed between the lift cage and the cylindrical shell, whereby the rotation of said intermediate means about its axis is blocked. The cylindrical shell and the lift cage are rotatably connected to the intermediate means. Vertical movement takes place by rotation of the cylindrical shell with respect to said intermediate means.

In this embodiment it is possible to have the lift cage make a controlled rotary motion with respect to the intermediate means, and the lift shaft may be provided with doors which are turned relative to the central axis.

Figure 7:
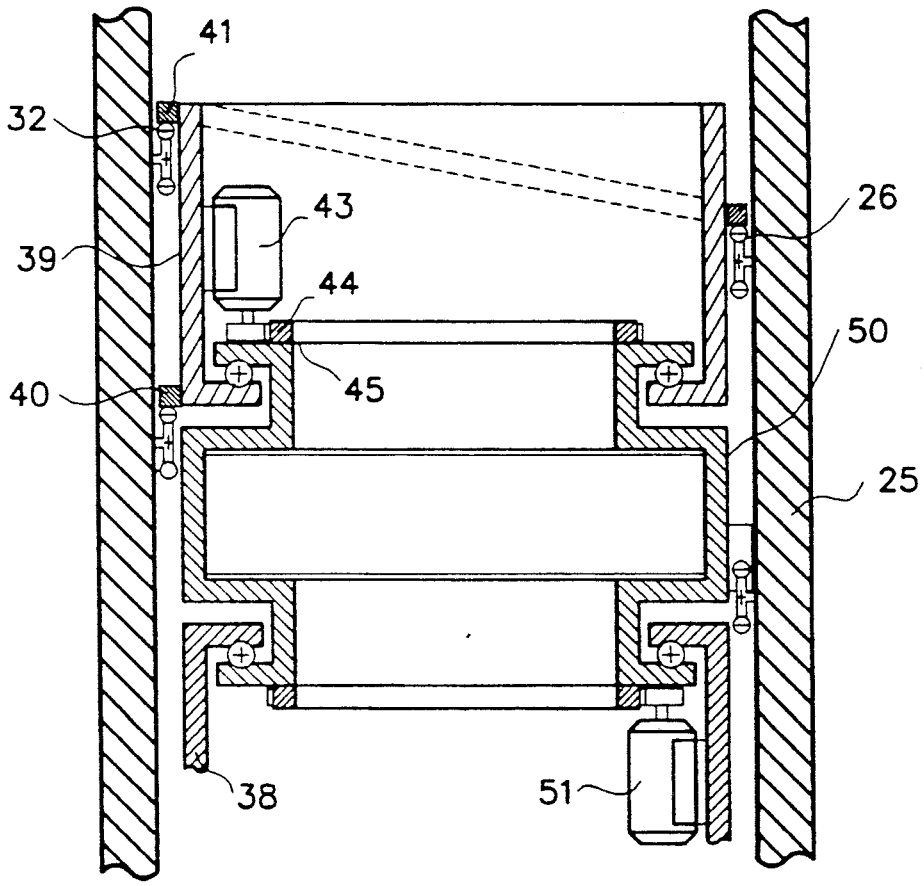
FIG. 7 is a sectional side elevation view of a part of the lift shaft and a part of the lift cage including an intermediate structure for rotating the cage relative to the support structure.

FIG. 7 shows an intermediate structure 50 secured between the support member 39 and the cage 38. A drive means 51 is coupled to the cage 38 for rotating the cage relative to the support member 39.

Figure 8:
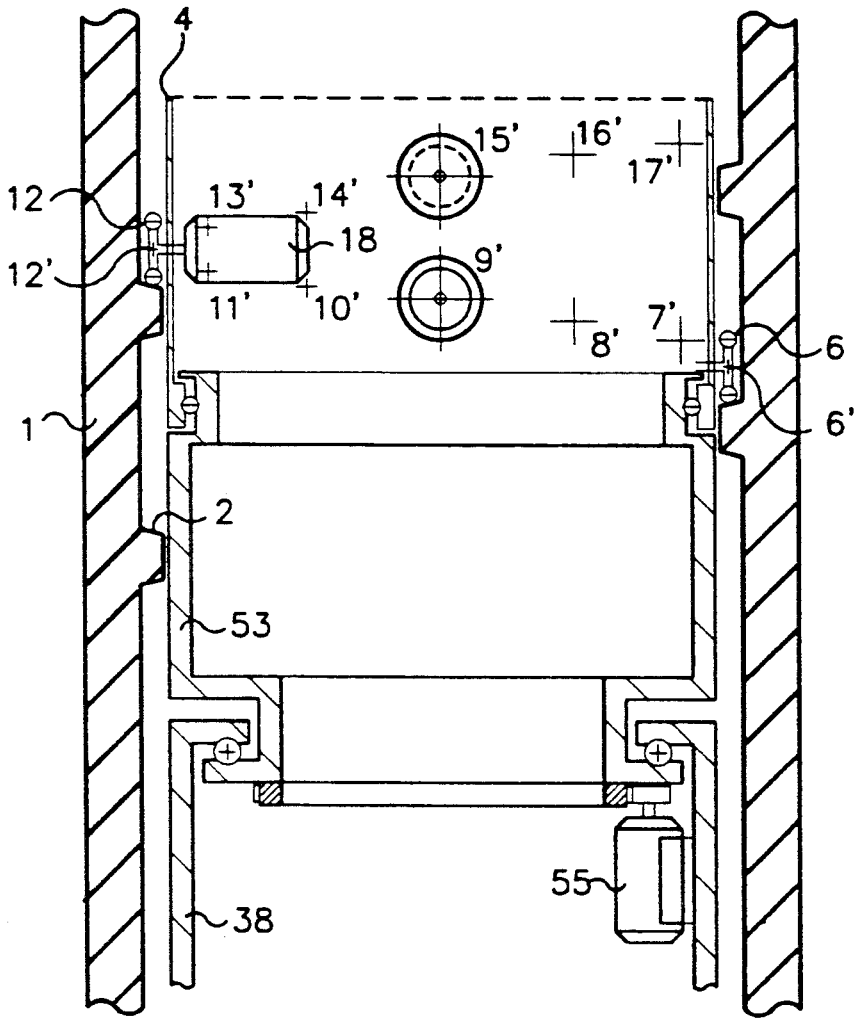
FIG. 8 is a sectional side elevational view of the lift shaft and lift cage including an intermediate structure.

FIG. 8 shows an intermediate structure 53 that can be alternatively used with the embodiment of FIG. 1. The intermediate structure 53 is secured between the shell 4 and the cage 38. A rotational motor 55 is secured to the cage 38 for rotating the cage relative to the intermediate structure 53 and the shell 4.

As is illustrated in FIG. 6 the lift cage 38 may be equipped with doors 46, which can be put from a closed position into an open positon by rotation about the central axis of the lift cage 38. In a similar manner two doors 39 may be provided near a doorway in the lift shaft, which doors 39 can be slightly moved outwards from their closed position illustrated in FIG. 3, and which can then be rotated in order to release the doorway in the lift shaft. Near said doorway a suitable threshold may be provided for bridging the distance between the inner wall of the lift shaft and the outer wall of the lift cage. A suitable placement of the helical rail with respect to the doorways will eliminate any risk of the helical rail 41 coming into contact with such a threshold.

The helical rail 41 will not be locally supported near a doorway. Since the helical rail is at all times supported on a large number of wheel-shaped means this will not necessarily be a drawback, however.

Of course alterations and/or additions to the construction described above are possible within the spirit and scope of the invention. Thus the wheel-shaped means may be replaced by sliding means or (electro)-magnets.

Also it is possible for the wheel-shaped means, or the rails, as the case may be, to be secured to a plurality of vertical columns, between which transparent walls may be provided in order to screen the lift cage. In such a case the movement of the lift cage can be followed from outside.

Instead of suspending the lift cage from a shell disposed above the lift cage it will also be possible to place the lift cage on top of a shell or support means disposed under the lift cage.

Rotation of the lift cage about the central axis of the lift shaft with respect to the stationary lift shaft may also be effected by means of helical guides provided on the lift shaft, instead of the guides 42 and 42'.

With the embodiment of FIG. 1–3 it is e.g. possible to have a runner mounted on the lift cage roll on the rail 2. By driving said runner in the one or the other direction by means of a motor, if desired, the lift cage can thus be rotated with respect to the shell 4 and the stationary lift shaft 1.

I claim:

1. A lift installation comprising:

a vertically orientated helical track;

a support member having wheels riding on said helical track and having a shell connected to said wheels;

drive means for turning said wheels, whereby said support member is caused to move vertically;

a lift cage having an opening and being rotatably connected to said shell; and rotation means for rotating said lift cage about a vertical axis, whereby said opening is caused to rotate about said vertical axis.

2. The lift installation according to claim 1, further including means for controlling said drive means whereby said support member is caused to move vertically in a desired manner.

3. The lift installation according to claim 2, further including means for controlling said rotation means whereby said opening is caused to rotate in a desired manner.

4. The lift installation according to claim 3 wherein said helical track is a helical rail.

5. The lift installation according to claim 3 wherein said drive means includes a motor.

6. The lift installation according to claim 3 wherein said rotation means includes a motor.

7. A lift installation comprising:

a vertically oriented structure;

a plurality of wheels connected to said structure and helically disposed about said structure;

a support member having a helical track operatively riding on said wheels and having a shell connected to said helical track;

drive means for rotting said support member relative to said structure, whereby said support member is caused to move vertically;

a lift cage having an opening and being rotatable connected to said shell; and rotation means for rotating said lift cage about a vertical axis, whereby said opening is caused to rotate about said vertical axis.

8. The lift installation according to claim 7, further including means for controlling said drive means whereby said support member is caused to move vertically in a desired manner.

9. The lift installation according to claim 8, further including means for controlling said rotation means whereby said opening is caused to rotate in a desired manner.

10. The lift installation according to claim 9 wherein said helical track is a helical rail.

11. The lift installation according to claim 9 wherein said drive means includes a motor.

12. The lift installation according to claim 9 wherein said rotation means includes a motor.

13. A lift installation comprising:

a vertically orientated support structure having a helical track;

a support member having wheels operatively connected to said helical track and a shell connected to said wheels;

drive means for driving said wheels, whereby said support member is caused to rotate and move vertically;

an intermediate structure rotatably connected to said shell;

a lift cage having an opening and being rotatably connected to said intermediate structure; and rotation means for rotating said lift cage relative to said intermediate structure, whereby said opening is caused to rotate.

14. The lift installation according to claim 13, further including means for controlling said drive means whereby said support member is caused to move vertically in a desired manner.

15. The lift installation according to claim 14, further including means for controlling said rotation means whereby said opening is caused to rotate in a desired manner.

16. The lift installation according to claim 15 wherein said helical track is a helical rail.

17. The lift installation according to claim 15 wherein said drive means includes a drive motor.

18. The lift installation according to claim 15 wherein said rotation means includes a rotational motor.

19. The lift installation according to claim 18 wherein said intermediate structure and said rotation means have intermeshing gears, and wherein said rotational motor rotates said rotation means gear to effectuate rotation of said lift cage.

* * * * *

UNITED STATES PATENT AND TRADEMARK OFFICE

CERTIFICATE OF CORRECTION

PATENT NO. : 5,125,346

DATED : June 30, 1992

INVENTOR(S) : Harry C. Piepers

It is certified that error appears in the above-identified patent and that said Letters Patent is hereby corrected as shown below:

In column 5, claim 7, line 31, please delete "rotting" and substitute therefor -- rotating --.

Signed and Sealed this

Tenth Day of August, 1993

*Attest:*

Michael K. Kirk

MICHAEL K. KIRK

*Attesting Officer*

*Acting Commissioner of Patents and Trademarks*